US009824564B2

(12) United States Patent
Bressanutti et al.

(10) Patent No.: US 9,824,564 B2
(45) Date of Patent: Nov. 21, 2017

(54) ASPIRATED SMOKE DETECTOR WITH IMPROVED OPTICAL CHAMBER

(71) Applicant: Honeywell International Inc., Morristown, NJ (US)

(72) Inventors: Massimo Bressanutti, Sesto al Reghena (IT); Mauro Miheli, Trieste (IT); Dino Petronio, Trieste (IT)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 14/968,136

(22) Filed: Dec. 14, 2015

(65) Prior Publication Data

US 2017/0169682 A1 Jun. 15, 2017

(51) Int. Cl.
*G08B 17/00* (2006.01)
*G08B 17/107* (2006.01)

(52) U.S. Cl.
CPC ..... *G08B 17/107* (2013.01)

(58) Field of Classification Search
CPC ..... G08B 17/10; G08B 17/103; G08B 17/107
USPC ..... 340/630
See application file for complete search history.

(56) References Cited

U.S. PATENT DOCUMENTS 5,400,014 A * 3/1995 Behlke ..... G08B 17/107 250/574
6,351,219 B1 * 2/2002 Tanguay ..... G08B 17/113 250/574
6,521,907 B1 * 2/2003 Shoaff ..... G08B 17/113 250/573
7,697,140 B2 * 4/2010 Iguchi ..... G01N 21/53 250/574
8,743,366 B2 * 6/2014 Numao ..... G08B 17/10 356/246
9,098,988 B2 8/2015 Ju et al.
D770,929 S 11/2016 Bressanutti et al.
2002/0089426 A1 * 7/2002 Qualey, III ..... G08B 17/113 340/628
2008/0018485 A1 * 1/2008 Kadwell ..... G08B 17/107 340/630
2008/0297361 A1 * 12/2008 Cole ..... G08B 17/103 340/630
2012/0262714 A1 * 10/2012 Gonzales ..... G01N 21/4738 356/338
2014/0168647 A1 * 6/2014 Ju ..... G01N 21/53 356/338
2015/0302727 A1 * 10/2015 Piccolo, III ..... G08B 29/145 340/514

OTHER PUBLICATIONS

System Sensor® Series 200 Advanced—Raising intelligent fire detection to a new level, Copyright © 2008 System Sensor.

(Continued)

*Primary Examiner* — Zhen Y Wu
(74) *Attorney, Agent, or Firm* — Husch Blackwell LLP

(57) ABSTRACT

An aspirated smoke detector with an improved optical chamber is provided. The aspirated smoke detector can include a base, an optical block housed within the base, the optical block housing an emitter and a receiver, and a chamber cover disposed over the base and the optical block to form an optical chamber therebetween. The chamber cover can capture light emitted by the emitter and reflect the captured light within the chamber cover while avoiding multiple back reflections of the captured light.

13 Claims, 3 Drawing Sheets

(56) References Cited

OTHER PUBLICATIONS

System Sensor® Series 200 Advanced—Photoelectric Smoke Detector Model 22051E, Copyright © 2009 System Sensor.
System Sensor® Aspiration Smoke Detection—FAAST LT LOOP Model, Copyright © 2012 System Sensor.
Extended European search report from corresponding EP patent application 16199898.4, dated May 11, 2017.

* cited by examiner

ASPIRATED SMOKE DETECTOR WITH IMPROVED OPTICAL CHAMBER

FIELD

The present invention relates generally to aspirated smoke detectors. More particularly, the present invention relates to an aspirated smoke detector with an improved optical chamber.

BACKGROUND

Aspirated smoke detectors are known in the art, and known aspirated smoke detectors include a highly sensitive smoke sensor in an optical chamber of a detector. For example, highly sensitive smoke sensors used in known aspirated smoke detectors are 10-50 times more sensitive than standard point photoelectric sensors.

Known aspirated smoke detectors include an emitter and a receiver. For example, the emitter can include a laser diode or high efficiency LED that emits light, and the receiver can include a sensing receiver, such as a photodiode. The laser diode can be combined with a lens and a mirror to output an optical signal with a high signal-to-noise ratio, and the sensing receiver can be illuminated by light that is scattered by smoke particles in the optical chamber, thereby triggering an alarm signal. In order to avoid saturation of the photodiode, known optical chambers are designed so that a high intensity beam emitted by the laser diode does not reach the receiver directly. Instead, the emitted light beam is projected onto a light trap, where a fraction of luminous flux is captured by a second monitoring receiver for monitoring a proper operation of the optical system.

The described architecture of optical chambers with such highly sensitive smoke sensors and other architecture known in the art require a complex and expensive manufacturing process. Moreover, the described complexity of these optical chambers influences the effectiveness of a calibration process and the reproducibility and repeatability of the detectors.

In view of the above, there is a continuing, ongoing need for an aspirated smoke detector with an improved optical chamber.

DETAILED DESCRIPTION

Figure 1:
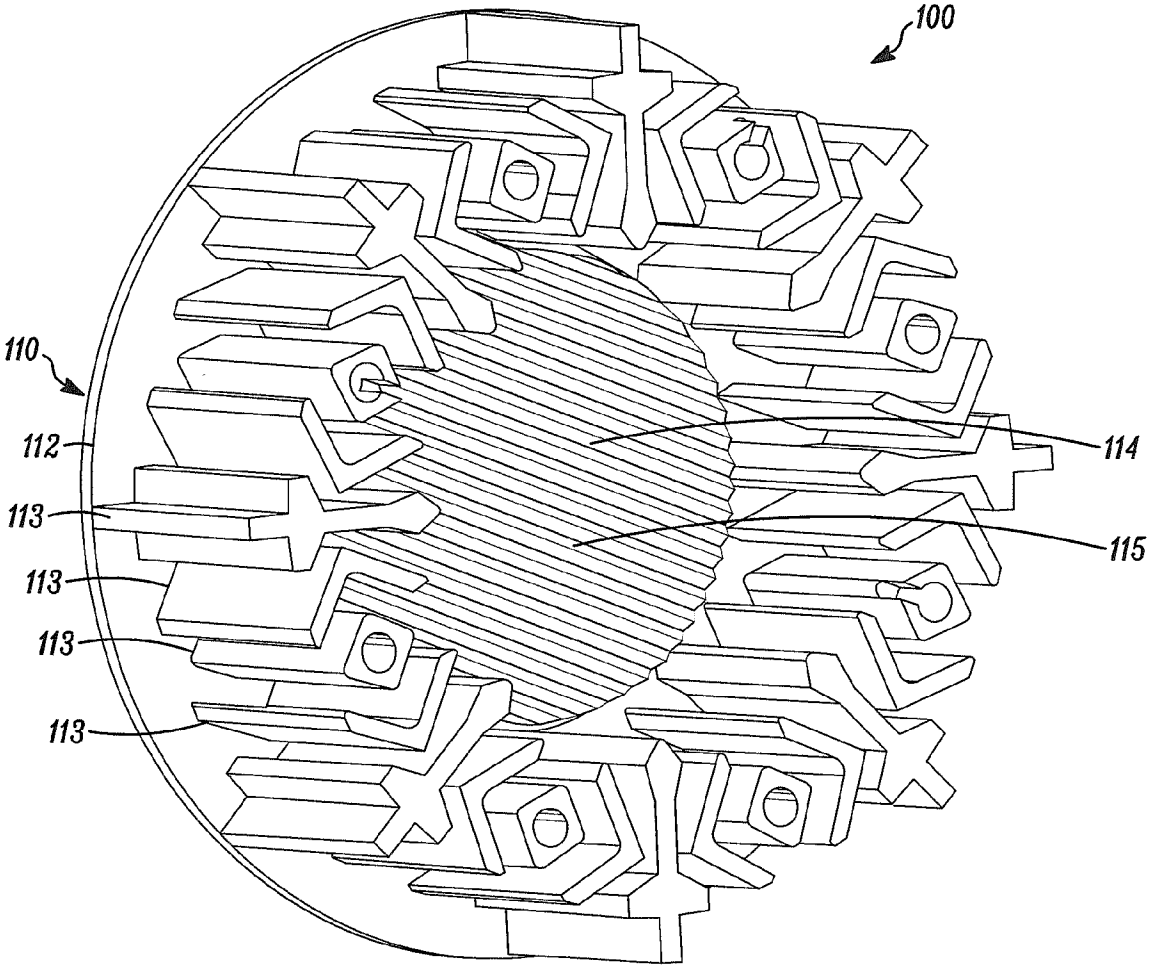
FIG. 1 is a perspective view of a first, inside side of a chamber cover in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein include an aspirated smoke detector with an improved optical chamber. In accordance with disclosed embodiments, the improved optical chamber can include a highly sensitive smoke sensor that can have a reliable calibration process. Moreover, the detector, including the optical chamber, can be highly reproducible, highly repeatable, and manufactured in a simple and cost-effective manner.

In some embodiments, the optical chamber as disclosed herein can include a single emitter and a single receiver integrated into one optical block, for example, a plastic optical block. Indeed, in some embodiments, the optical chamber as disclosed herein can eliminate the need for any mirrors, lenses, or other optical devices that need alignment.

In some embodiments, the optical chamber as disclosed herein can include a symmetrical cover that can permit smoke to easily enter the chamber. The chamber cover disclosed herein can also provide a repeatable way for a high gain optical system (including the optical chamber and the emitter, receiver, and their related electronics) to generate a signal with a low clean air value. In this regard, it is to be understood that a clean air value is a value of a signal output from a photodiode amplifier stage when the optical chamber is clean. It is to be further understood that the clean air value is the result of an interaction between the emitter and the receiver, their related electronic states (emitter driver and photodiode amplifier), and the optical chamber itself. When the clean air value of an output signal is low, a range of signal values for smoke detection can be wide.

In some embodiments, the optical chamber cover as disclosed herein can absorb luminous flux of light emitted by the emitter and reflect only a small portion, in a repeatable way, on the receiver. To absorb and reflect in this manner, the chamber cover can include a plurality of input sector members that capture the light and direct the captured light in angled corridors therebetween in such a manner so as to avoid multiple back reflections. When the luminous flux of the light emitted by the receiver is absorbed by the optical chamber cover, only a small amount of the light illuminates walls of the optical chamber where dust and other small objects can settle. Accordingly, the optical chamber disclosed herein can have a high immunity to such dust and dirt.

The optical chamber as disclosed herein can include the optical block, which can include the emitter and the receiver, a base, for example, a plastic base, and the chamber cover. The optical block and the base can form a lower part of the optical chamber, and in some embodiments, the optical block can include the optical block as disclosed in U.S. Design patent application Ser. No. 29/405,060 filed Jun. 26, 2014 and titled "Optical Block". U.S. Design patent application Ser. No. 29/405,060 is assigned to the assignee hereof and is hereby incorporated by reference.

The chamber cover as disclosed herein can form an upper and lateral part of the optical chamber. As explained above, the chamber cover can include the plurality of input sector members. In some embodiments, the input sector members can be modular and can have a repetitive structure to ensure low directionality while facilitating easy entrance for the smoke into the chamber. As further explained above, the input sector members of the chamber cover can capture the light and direct the captured light in the angled corridors therebetween while permitting only a low and reproducible back reflection, thereby enabling the low clean air value of the signal output by the receiver. Indeed, in some embodiments, the clean air value of the output signal can be used for the reliable and effective calibration and lifetime operation monitoring of a highly sensitive photoelectric sensor. In some embodiments, the calibration process can be executed in a production cell of the highly sensitive sensor at an end of the manufacturing process.

FIG. 1 is a perspective view of a first, inside side of the chamber cover 100 in accordance with disclosed embodiments. As seen in FIG. 1, the cover 100 can include a flat, annular disc 110 that includes an outer concentric ring 112 and an inner concentric ring 114. A plurality of ribs 115 can traverse the inner concentric ring 114 in any direction as would be desired by one of skill in the art and can cancel or attenuate light reflection of a chamber ceiling within the optical chamber.

The plurality of sector members 113 can be disposed on the outer concentric ring 112 and protrude from the outer concentric ring 112 an equal distance away from the disc 110 such that each sector member 113 can have a substantially equal length. The sector members 113 can have varying shapes, but can be shaped and arranged relative to one another so as to form the angled corridors therebetween that capture the light and direct the captured light in such a manner so as to avoid the multiple back reflections. As seen in FIG. 1, the sector members 113 can be modular and can have a repetitive structure. For example, in some embodiments, four or eight modules of the sector members 113 can be disposed on the outer concentric ring 112 of the chamber cover 100 in a repeating manner.

Figure 2:
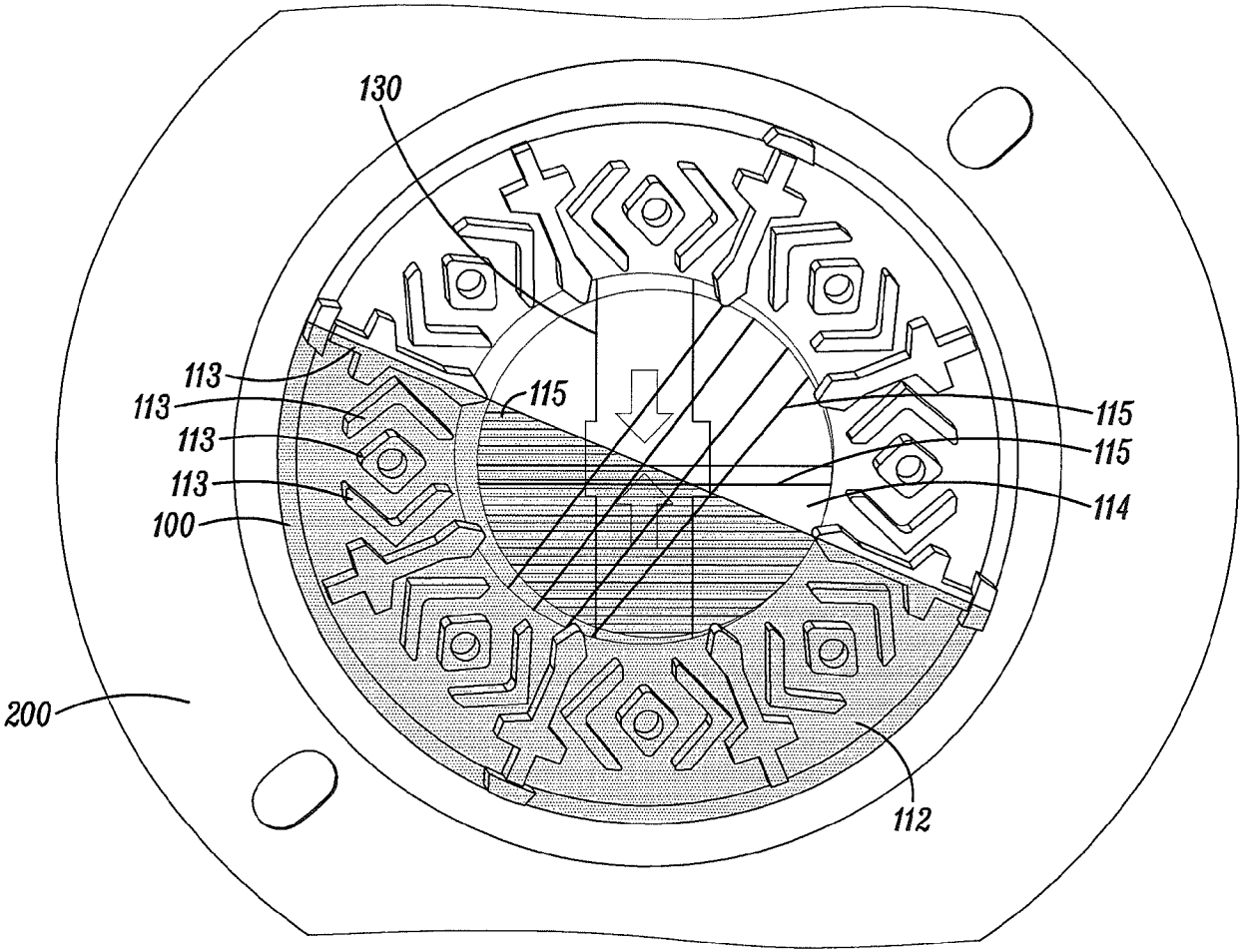
FIG. 2 is a top cross-sectional view of a chamber cover mounted on a detector to form an optical chamber in accordance with disclosed embodiments.
Figure 3:
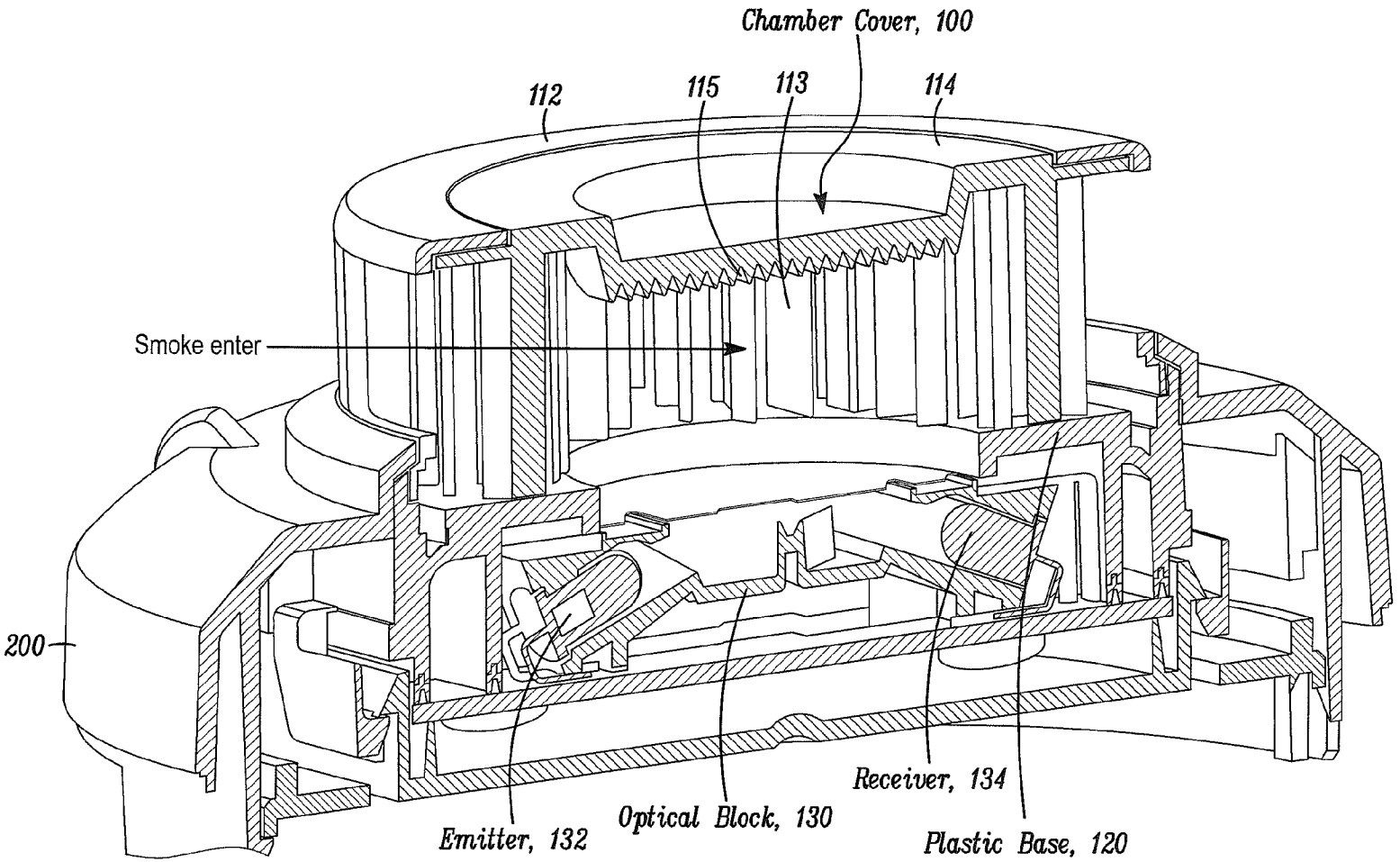
FIG. 3 is a side cross-sectional view of a chamber cover mounted on a detector to form an optical chamber in accordance with disclosed embodiments.

FIG. 2 is a top cross-sectional view and FIG. 3 is a side cross-sectional view of the chamber cover 100 mounted on the detector 200 to form the optical chamber in accordance with disclosed embodiments. As seen in FIG. 2, embodiments disclosed herein are not limited by a direction in which the ribs 115 traverse the inner concentric ring 114 of the chamber cover 100.

As further in seen in both FIG. 2 and FIG. 3, the chamber cover 100 can allow the smoke to enter the optical chamber through spaces between the sector members 113 and be disposed over the base 120 and the optical block 130 that includes the emitter 132 and the receiver 134, thereby forming the optical chamber. However, it is to be understood that the base 120 and the optical block 130 of the detector disclosed herein are not limitations of the present invention. Instead, the chamber cover 100 disclosed herein can be mounted on or in connection with any detector, base, or optical block as would be desired by one of ordinary skill in the art. For example, the chamber cover 100 disclosed herein can be mounted in a single or dual channel aspirating module or on a detector that includes a photoelectric sensor, such as, for example, a high sensitivity laser detector.

In some embodiments, the chamber cover disclosed herein can be manufactured via a thermoplastic molding process. For example, grains of virgin plastic can copy a shape of a metallic cavity when high temperatures and pressure are introduced in a dedicated press. In some embodiments, the optical block and the base can be manufactured in a separate manufacturing cell, and the emitter and receiver, such as the high sensitivity photoelectric sensor, can be calibrated thereafter while the optical block is in the manufacturing cell. Then, the manufactured optical block, base, and chamber cover can be mounted in an aspirating system as would be known in the art for final assembly of the detector.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. An aspirated smoke detector comprising: a base;

an optical block housed within the base, the optical block housing an emitter and a receiver; and a chamber cover disposed over the base and the optical block to form an optical chamber therebetween, wherein the chamber cover captures light emitted by the emitter and reflects the light captured by the chamber cover within the chamber cover while avoiding multiple back reflections of the light captured by the chamber cover, wherein the chamber cover includes a plurality of varying shape sector members disposed on an outer concentric ring of the chamber cover and extending into the optical chamber, wherein first respective ones of the plurality of varying shape sector members having a first shape are arranged relative to second respective ones of the plurality of varying shape sector members having a second shape so as to form a plurality of angled corridors therebetween, and wherein each of the plurality of varying shape sector members is symmetrical.

2. The aspirated smoke detector of claim 1 wherein the light emitted by the emitter and received by the receiver fails to pass through a mirror or a lens.

3. The aspirated smoke detector as in claim 1 wherein the chamber cover is symmetrical.

4. The aspirated smoke detector as in claim 1 wherein each of the plurality of varying shape sector members directs the light captured by the chamber cover into a respective angled corridor of the plurality of angled corridors.

5. The aspirated smoke detector as in claim 1 wherein the plurality of varying shape sector members form a repeating pattern of shapes on the outer concentric ring.

6. The aspirated smoke detector as in claim 1 wherein the chamber cover reflects the light emitted by the emitter into the optical chamber in a repeatable manner.

7. The aspirated smoke detector as in claim 1 wherein the chamber cover includes an inner concentric ring, and wherein a plurality of ribs traverse the inner concentric ring and attenuate light reflection within the optical chamber.

8. A chamber cover for an optical chamber of an aspirated smoke detector comprising:

an annular disc that includes an outer concentric ring and an inner concentric ring;

a plurality of ribs traversing the inner concentric ring; and a plurality of varying shape sector members protruding from a first side of the outer concentric ring, wherein first respective ones of the plurality of varying shape sector members having a first shape are arranged relative to second respective ones of the plurality of varying shape sector members having a second shape so as to form a plurality of angled corridors therebetween, and wherein each of the annular disc, the plurality of ribs, and the plurality of varying shape sector members is symmetrical.

9. The chamber cover of claim 8 wherein the plurality of varying shape sector members form a repeating pattern of shapes on the outer concentric ring.

10. The chamber cover of claim 8 wherein at least one of the annular disc, the plurality of ribs, and the plurality of varying shape sector members comprises plastic.

11. A method comprising:

an emitter emitting light into an optical chamber of an aspirated smoke detector;

a chamber cover capturing a first portion of the light emitted by the emitter; and the chamber cover reflecting the first portion of the light within the chamber cover while avoiding multiple back reflections of the first portion of the light, wherein the chamber cover reflecting the first portion of the light within the chamber cover includes a plurality of varying shape sector members of the chamber cover directing the first portion of the light into respective ones of angled corridors formed between differently shaped members of the plurality of varying shape sector members, and wherein each of the plurality of varying shape sector members is symmetrical.

12. The method of claim 11 further comprising the chamber cover reflecting a second portion of the light emitted by the emitter into the optical chamber in a repeatable manner.

13. The method of claim 12 further comprising a receiver receiving the second portion of the light reflected by the chamber cover.

* * * * *